US005496419A

United States Patent [19]

Murakami et al.

[11] Patent Number: 5,496,419

[45] Date of Patent: Mar. 5, 1996

[54] WEAR-RESISTANT HIGH PERMEABILITY MAGNETIC ALLOY AND METHOD OF MANUFACTURING THE SAME

[75] Inventors: Yuetsu Murakami; Katashi Masumoto, both of Sendai, Japan

[73] Assignee: The Foundation: The Research Institute of Electric and Magnetic Alloys, Japan

[21] Appl. No.: 254,892

[22] Filed: Jun. 6, 1994

[30] Foreign Application Priority Data

Jul. 30, 1993 [JP] Japan ..... 5-190215

[51] Int. Cl.[6] ..... C22C 19/03

[52] U.S. Cl. ..... 148/312; 148/409; 420/459

[58] Field of Search ..... 148/409, 426, 148/312; 420/459

[56] References Cited

U.S. PATENT DOCUMENTS

| | | | |
|---|---|---|---|
| 3,743,550 | 7/1973 | Masumoto et al. | 420/459 |
| 3,837,930 | 9/1974 | Masumoto et al. | 420/459 |
| 3,871,927 | 3/1975 | Masumoto et al. | 148/312 |
| 4,440,720 | 4/1984 | Masumoto et al. | 148/312 |
| 4,572,750 | 2/1986 | Masumoto et al. | 420/459 |
| 4,710,243 | 12/1987 | Masumoto et al. | 148/426 |

FOREIGN PATENT DOCUMENTS

| | | |
|---|---|---|
| 63-100148 | 5/1988 | Japan . |
| 4-006249 | 1/1992 | Japan . |

*Primary Examiner*—George Wyszomierski
*Attorney, Agent, or Firm*—Parkhurst, Wendel & Rossi

[57] ABSTRACT

The present invention provides a wear resistant high permeability magnetic alloy Ni, Nb, N, O and Fe as main components. The alloy may include secondary components of at least one element selected from the group consisting of Cr, Mo, Ge, Au, Co, V, W, Cu, Ta, Mn, Al, Si, Ti, Zr, Hf, Sn, Sb, Ga, In, Tl, Zn, Cd, rare earth element, platinum element, Be, Ag, Sr, Ba, B, P, C and S. The magnetic alloy has good wear resistance having easy forgeability, a large effective permeability, more than 4000 G of a saturated flux density and a recrystallization texture of {110}<112>+{311}<112>.

9 Claims, 7 Drawing Sheets

WEAR-RESISTANT HIGH PERMEABILITY MAGNETIC ALLOY AND METHOD OF MANUFACTURING THE SAME

BACKGROUND OF THE INVENTION

1. Field of the Invention

The present invention relates to a wear-resistant high permeability alloy consisting of Ni, Nb, N, O and Fe as main ingredients and at least one element selected from the group consisting of Cr, Mo, Ge, Au, Co, V, W, Cu, Ta, Mn, Al, Si, Ti, Zr, Hf, Sn, Sb, Ga, In, Tl, Zn, Cd, rare earth element, platinum element, Be, Ag, Sr, Ba, B, P, C and S as a secondary ingredient, a method of manufacturing same and a magnetic recording and reproducing head utilizing same. An object of the invention is to provide an excellent wear-resistant high permeability magnetic alloy having a recrystallization texture of {110}<112>+{311}<112> with easy forgability, a large effective permeability and a saturated flux density of more than 4000 G.

2. Related Art Statement

A magnetic recording and reproducing head for tape recorder and video tape recorder is operated in an alternating current magnetic field, so that a magnetic alloy used therefor is required to have a large effective permeability in a high frequency magnetic field, and is desired to be wear-resistant because the head is slid by contacting a magnetic tape. At present, as a magnetic alloy having an excellent wear resistance for magnetic recording and reproducing head, there are Sendust (FE—Si—Al alloy) and ferrite (MnO—ZnO—$Fe_2O_3$), but they are very hard and brittle, thereby it is impossible to process for forging and mill working, so that a polishing process is used for manufacturing a head core of these alloy. As a result, its product becomes expensive. Moreover, Sendust (trade name) is large in saturated flux density, but cannot be formed into a thin sheet, so that it is relatively small in effective permeability in high frequency magnetic field. Furthermore, ferrite is large in effective permeability, but is disadvantageouly small in saturated flux density such as about 4000 G. On the other hand, a permalloy (trade name) (Ni—Fe alloy) is large in saturated flux density, but is small in effective permeability, and it is easy in forging, mill working and punching, and excellent in mass-production, but is easily worn out, which improvement of wear-resistant property is strongly desired.

SUMMARY OF THE INVENTION

The present inventors have found that Ni—Fe—Nb—N alloy and Ni—Fe—Nb—O alloy are easily forgeable, and have a high hardness and a high permeability and it is suitable as magnetic alloy for magnetic recording and reproducing head, and filed patent applications (Japanese Patent Application Publication No. 62-5972 and Japanese Patent Application Publication No. 62-12296). Thereafter, the present inventors have systematically continued a study for wear-resistant property of Ni—Fe— Nb—N alloy and Ni—Fe—Nb—O alloy, and as a result, it becomes clear that the wear-resistant property is not unconditionally determined by hardness, but closely related to the recrystallization texture of an alloy.

In general, it has been known that a wear phenomenon largely differs by the crystallization texture of an alloy and a crystalline anisotropy is existent, but it becomes clear in Ni—Fe—Nb alloy that a {100}<001> recrystallization texture is easily worn out, and recrystallization textures of

{110}<112> and {311}<112> slightly rotated around this <112> direction are excellent in wear resistance. That is, it was found that the Ni—Fe—Nb alloy is remarkably improved in wear resistant property by forming a recrystallization texture of {110}<112>+{311}<112>.

The present inventors have executed many studies for forming a recrystallization texture of {110}<112>+{311}<112> of Ni—Fe—Nb alloy based on this knowledge, and as a result, found that when 0.0003–0.3% in total of N and O is added thereto, the development of a {100}<001> recrystallization texture is suppressed, and the formation of a recrystallization texture of {110}<112>+{311}<112> is considerably accelerated. That is, it has been known that when Ni—Fe binary alloy is cold-rolled, a crystal texture of {110}<112>+{112}<111> is generated, but if it is heated at high temperature, a {110}<001> recrystallization texture is developed. However, when Nb is added thereto, the stacking fault energy is lowered, but 0.0003–0.3% in total of nitrogen (N) and oxygen (O) is further added thereto, nitride and oxide are separated in a grain boundary to lower grain boundary energy, the development of a recrystallization texture of {100}<001> is strongly suppressed in recrystallization, a growth of a recrystallization texture of {110}<112>+{311}<112> is preferentially accelerated, a recrystallization structure of {110}<112>+{311}<112> is formed, and the wear resistance is remarkably improved. It has also been found that when nitrogen (N) and oxygen (O) are added to Ni—Fe—Nb alloy, a hard nitride and oxide are separated in a matrix so as to contribute to improvement of wear resistance, a magnetic domain is divided by dispersion and a separation of these ferromagnetic, weak magnetic and nonmagnetic fine nitride and oxide, an eddy current loss in an alternating current field is decreased, so that effective permeability is increased. In short, a recrystallization texture of {110}<112>+{311}<112> is developed, an effective permeability is increased and a high permeability alloy having an excellent wear resistance is obtained by synergistic effect of these element of niobium (Nb), nitrogen (N) and oxygen (O).

An object of the present invention is to provide a wear-resistant high permeability magnetic alloy consisting by weight of 60–90% Ni, 0.5–14% Nb, 0.0003–0.3% N and O in total (but excluding 0% of N and O) and the remainder Fe and a little amount of impurities and having more than 3000 of an effective permeability at 1 KHz, more than 4000 G of a saturated flux density, and a recrystallization texture of {110}<112>+{311}<112>.

Another object of the present invention is to provide a wear-resistant high permeability magnetic alloy consisting by weight of 60–90% Ni, 0.5–14% Nb, 0.0003–0.3% N and O in total (but excluding 0% of N and O) as main ingredients, and as a secondary ingredient, 0.001–30% in total of at least an element selected from the group consisting of less than 7% of Cr, Mo, Ge and Au, respectively, less than 10% of Co and V, respectively, less than 15% of W, less than 25% of Cu, Ta and Mn, respectively, less than 5% of Al, Si, Ti, Zr, Hf, Sn, Sb, Ga, In, Tl, Zn, Cd, rare earth element and platinum element, respectively, less than 3% of Be, Ag, Sr and Ba, respectively, less than 1% of B, less than 0.7% of P, less than 0.3% of C, and less than 0.1% of S, and the remainder Fe and a little amount of impurities, and having more than 3000 of an effective permeability at 1 KHz, more than 4000 G of a saturated flux density, and a recrystallization texture of {110}<112>+{311}<112>.

A further object of the present invention is to provide a method of manufacturing a wear-resistant high permeability magnetic alloy comprising hot working an alloy consisting by weight of 60–90% Ni, 0.5–14% Nb, 0.0003–0.3% N and O in total (but excluding 0% of N and O) and the remainder Fe and a little amount of impurities at a temperature exceeding 900° C. and below a melting point, thereafter cooling, then cold working at a reduction ratio of more than 50%, heating at a temperature exceeding 900° C. and below a melting point, and cooling from a temperature above an ordered-disordered lattice transformation point to a room temperature at a predetermined cooling rate of 100° C./sec to 1° C./hr corresponding to the composition, thereby forming an alloy having more than 3000 of an effective permeability at 1 KHz, more than 4000 G of a saturated flux density, and a recrystallization texture of {110}<112>+{311}<112>.

A still further object of the present invention is to provide a method of manufacturing a wear-resistant high permeability magnetic alloy comprising hot working an alloy consisting by weight of 60–90% Ni, 0.5–14% Nb, 0.0003–0.3% N and O (but excluding 0% of N and O), and the remainder Fe and a little amount of impurities at a temperature exceeding 900° C. and below a melting point, thereafter cooling, then cold working at a reduction ratio of more than 50%, then heating at a temperature exceeding 900° C. and below a melting point, and cooling from a temperature above an ordered-disordered lattice transformation point to a room temperature at a predetermined cooling rate of 100° C./sec to 1° C./hr corresponding to the composition, further heating at a temperature below an ordered-disordered transformation point for a predetermined time less than 1 minute and more than 100 hours of corresponding to the composition and cooling, thereby forming an alloy having more than 3000 of an effective permeability at 1 KHz, more than 4000 G of a saturated flux density, and a recrystallization texture of {110}<112>+{311}<112>.

Another object of the present invention is to provide method of manufacturing a wear-resistant high permeability alloy comprising hot working an alloy consisting by weight of 60–90% Ni, 0.5–14% Nb, 0.0003–0.3% N and O in total (but excluding 0% of N and O), and as a secondary ingredient, 0.001–30% in total of an element selected from the group consisting of less than 7% of Cr, Mo, Ge and Au, respectively, less than 10% of Co and V, respectively, less than 15% of W, less than 25% of Cu, Ta and Mn, respectively, less than 5% of Al, Si, Ti, Zr, Hf, Sn, Sb, Ga, In, Tl, Zn, Cd, rare earth element, and platinum element, respectively, less than 3% of Be, Ag, Sr and Ba, respectively, less than 1% of B, less than 0.7% of P, less than 0.3% of C and less than 0.1% of S and the remainder Fe and a little amount of impurities at a temperature exceeding 900° C. and below a melting point, cooling, then cold working at a reduction ratio of more than 50%, thereafter heating at a temperature exceeding 900° C. and below a melting point, then cooling from a temperature of more than an ordered-disordered lattice transformation point to a room temperature at a predetermined cooling rate of 100° C./sec to 1° C./hr corresponding to the composition, thereby forming an alloy having more than 3000 of an effective permeability at 1 KHz, more than 4000 G of a saturated flux density, and a recrystallization texture of {110}<112>+{311}<112>.

Another object of the present invention is to provide method of manufacturing a wear-resistant high permeability alloy comprising hot working an alloy consisting by weight of 60–90% Ni, 0.5–14% Nb, 0.0003–0.3% N and O in total (but excluding 0% of N and O), and as a secondary component, 0.001–30% in total of an element selected from the group consisting of less than 7% of Cr, Mo, Ge and Au, respectively, less than 10% of Co and V, respectively, less than 15% of W, less than 25% of Cu, Ta and Mn, respectively, less than 5% of Al, Si, Ti, Zr, Hf, Sn, Sb, Ga, In, Tl, Zn, Cd, rare earth element and platinum element, respectively, less than 3% of Be, Ag, Sr and Ba, respectively, less than 1% of B, less than 0.7% of P, less than 0.3% of C and less than 0.1% of S and the remainder Fe and a little amount of impurities at a temperature exceeding 900° C. and below a melting point, cooling, then cold working at a reduction ratio of more than 50%, thereafter heating at a temperature exceeding 900° C. and below a melting point for more than 1 minute and less than 100 hours, then cooling from a temperature of more than an ordered-disordered lattice transformation point to a room temperature at a predetermined cooling rate of 100° C./sec to 1° C./hr corresponding to the composition, thereby forming an alloy having more than 3000 of an effective permeability at 1 KHz, more than 4000 G of a saturated flux density, and a recrystallization texture of {110}<112>+{311}<112>.

An object of the present invention is to provide a method of manufacturing a wear-resistant high permeability alloy comprising hot working an alloy consisting by weight of 60–90% Ni, 0.5–14% Nb, 0.0003–0.3% N and O in total (but excluding 0% of N and O) and as a secondary component 0.001–30% in total of an element selected from the group consisting of less than 7% of Cr, Mo, Ge and Au, respectively, less than 10% of Co and V, respectively, less than 15% of W, less than 25% of Cu, Ta and Mn, respectively, less than 3% of Al, Si, Ti, Zr, Hf, Sn, Sb, Ga, In, Tl, Zn, Cd, rare earth element and platinum element, respectively, less than 3% of Be, Ag, Sr and Ba, respectively, less than 1% of B, less than 0.7% of P, less than 0.3% of C and less than 0.1% of S and the remainder Fe and a little amount of impurities, at a temperature exceeding 900° C. and below a melting point, thereafter cooling, then cold working at a working ratio of more than 50%, heating at a temperature exceeding 900° C. and below a melting point, then cooling from a temperature of more than an ordered-disordered lattice transformation point to a room temperature at a predetermined cooling rate of 100° C./sec to 1° C./hr corresponding to the composition, and further heating at a temperature of less than an ordered-disordered lattice transformation point for a predetermined time from more than 1 minute to less than 100 hours corresponding to the composition and cooling, thereby forming an alloy having a recrystallization texture of {110}<112>+{311}<112>, an effective permeability of more than 3000 at 1 KHz and a saturated flux density of more than 4000 G.

Another object of the present invention is to provide a method of manufacturing a wear-resistant high permeability alloy comprising hot working an alloy consisting by weight of 60–90% Ni, 0.5–14% Nb, 0.0003–0.3% N and O in total (but excluding 0% of N and O) and as a secondary component 0.001–30% in total of an element selected from the group consisting of less than 7% of Cr, Mo, Ge and Au, respectively, less than 10% of Co and V, respectively, less than 15% of W, less than 25% of Cu, Ta and Mn, respectively, less than 5% of Al, Si, Ti, Zr, Hf, Sn, Sb, Ga, In, Tl, Zn, Cd, rare earth element, and platinum element, respectively, less than 3% of Be, Ag, Sr, and Ba, respectively, less than 1% of B, less than 0.7% of P, less than 0.3% of C and less than 0.1% of S and the remainder Fe and a little amount of impurities, at a temperature exceeding 900° C. and below a melting point, thereafter cooling, then, cold working at a working ratio of more than 50%, heating at a temperature exceeding 900° C. and below a melting point, then cooling from a temperature above an ordered-disordered lattice transformation point to a room temperature at a predetermined cooling rate of 100° C./sec to 1° C./hr corresponding to the composition, thereby forming an alloy having a recrystallization texture of {110}<112>+{311}<112>, an effective permeability of more than 3000 at 1 KHz and a saturated flux density of more than 4000 G.

In order to manufacture an alloy of the present invention, a suitable amount of 60–90% by weight of Ni, 0.5–14% by weight of Nb and the remainder Fe are molten in air, a suitable mixed gas atmosphere of nitrogen and oxygen or in vacuo by using a suitable smelting furnace, thereafter, as they are, or further added as a secondary component element a predetermined amount of 0.001–30% in total of less than 7% of Cr, Mo, Ge and Au, less than 10% of Co and V, less than 15% of W, less than 25% of Cu, Ta and Mn, less than 5% of Al, Si, Ti, Zr, Hf, Sn, Sb, Ga, In, Tl, Zn, Cd, rare earth element and platinum element, less than 3% of Be, Ag, Sr and Ba, less than 1% of B, less than 0.7% of P, less than 0.3% of C and less than 0.1% of S, and fully stirred to manufacture a uniformly molten alloy in composition. Then, $N_2$, $N_3H$ and $O_2$ gas are introduced into the furnace for controlling pressure, or a suitable amount of nitride and oxide of alloy components is added so as to add a suitable amount of nitrogen and oxygen to the molten alloy.

Then, the alloy is injected into a mold of suitable shape and size to obtain a sound ingot, the ingot is further forged and hot worked (hot rolled) at a temperature exceeding 900° C. and below a melting point, preferably exceeding 1000° C. and below a melting point to form a sheet of suitable thickness, or annealed, if necessary. Then, the sheet is cold worked at more than 50% of a reduction ratio by a method such as cold rolling and the like, and there is manufactured a thin sheet of shape aimed at, such as 0.1 mm. Then, a ring-like sheet of 45 mm in outer diameter and 33 mm in inner diameter is punched from the thin sheet, and the ring-like sheet is heated in hydrogen, other suitable non-oxidizing atmosphere (hydrogen, argon, nitrogen and the like) or in vacuo at a temperature exceeding 900° C. and below a melting point, preferably exceeding 1000° C. and below a melting point for suitable time, then cooled from a temperature of more than an ordered-disordered lattice transformation point (about 600° C.) at a suitable cooling rate of 100° C./sec to 1° C./hr corresponding to the composition, or further reheated at a temperature of less than an ordered-disordered lattice transformation point (about 600° C.) for suitable time and cooled. Thus, there is obtained a wear-resistant high permeability alloy having more than 3000 of an effective permeability, more than 4000 G of a saturated flux density and a recrystallization texture of {110}<112>+{311}<112>.

BRIEF DESCRIPTION OF THE DRAWINGS

For a better understanding of the invention, reference is made to the accompanying drawing, in which.

DESCRIPTION OF THE PREFERRED EMBODIMENTS

Figure 1:
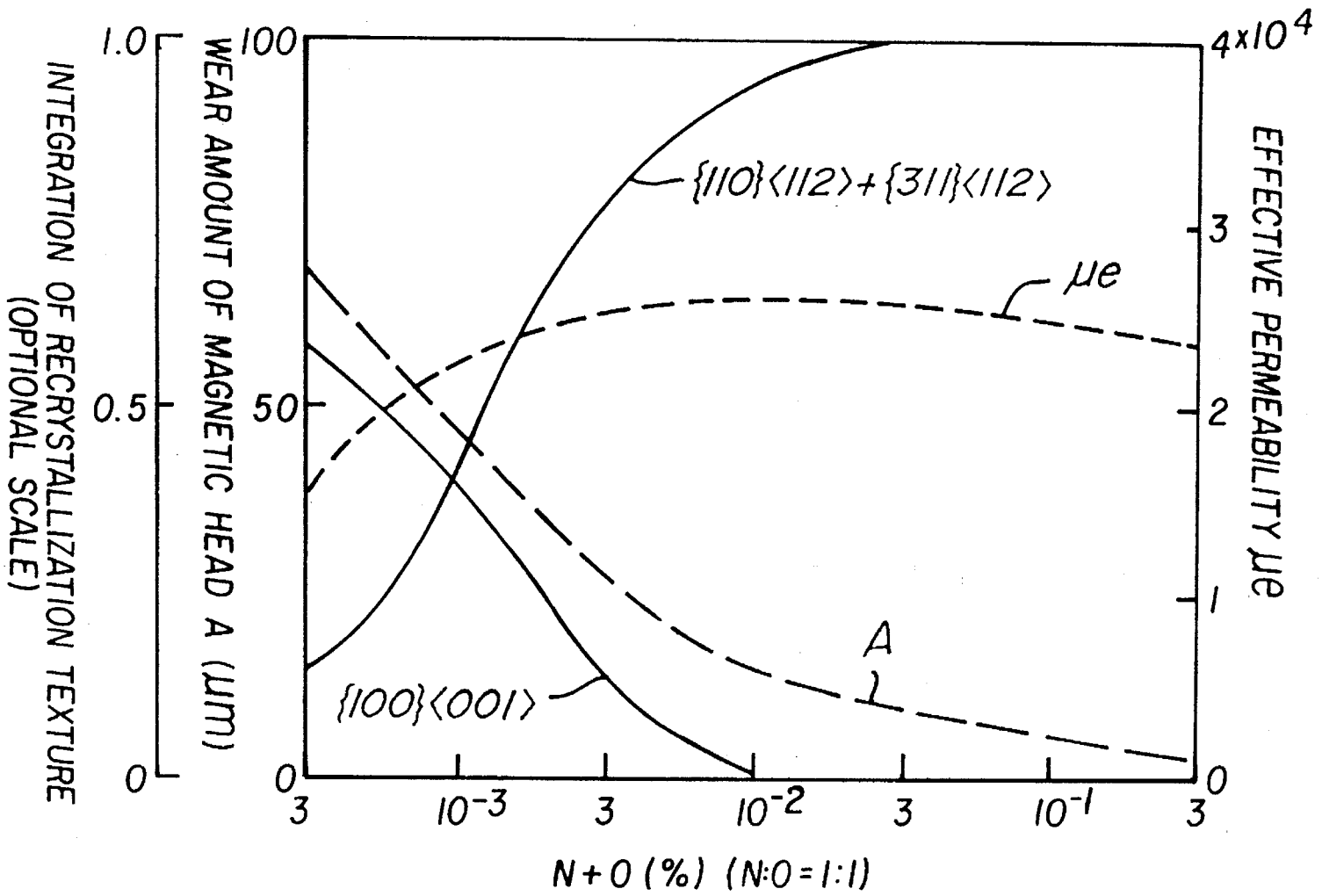
FIG. 1 is a graph showing the relationship between various properties and N and O amount of 79.5% Ni—Fe-5.5% Nb—N—O alloy, where N:O=1:1.

The present invention is further explained by referring to the drawings in detail.

FIG. 1 is a graph showing the relationship of a recrystallization texture and various properties and N and O amounts in case of cold rolling a 79.5% Ni—Fe-5.5% Nb—N—O alloy (where N:O=1:1) at a reduction ratio of 90% heating at 1150° C. and cooling at a cooling rate of 600° C./hr. When an Ni—Fe—Nb alloy is cold rolled, there is generated a work recrystallization texture of {110}<112>+{112}<111>, but if this is heated at a high temperature of more than 900° C., recrystallization textures of {100}<001> and {110}<112>+{311}<112> are generated. However, when N and O are added thereto, the formation of the recrystallization texture of {100}<001> is suppressed, and the recrystallization texture of {110}<112>+{311}<112> is developed, and a wear amount is decreased together with the generation of said texture. Moreover, an effective permeability is increased by an addition of N and O, but an addition of more than 0.3% of N and O is not preferable, because forging becomes difficult.

Figure 2:
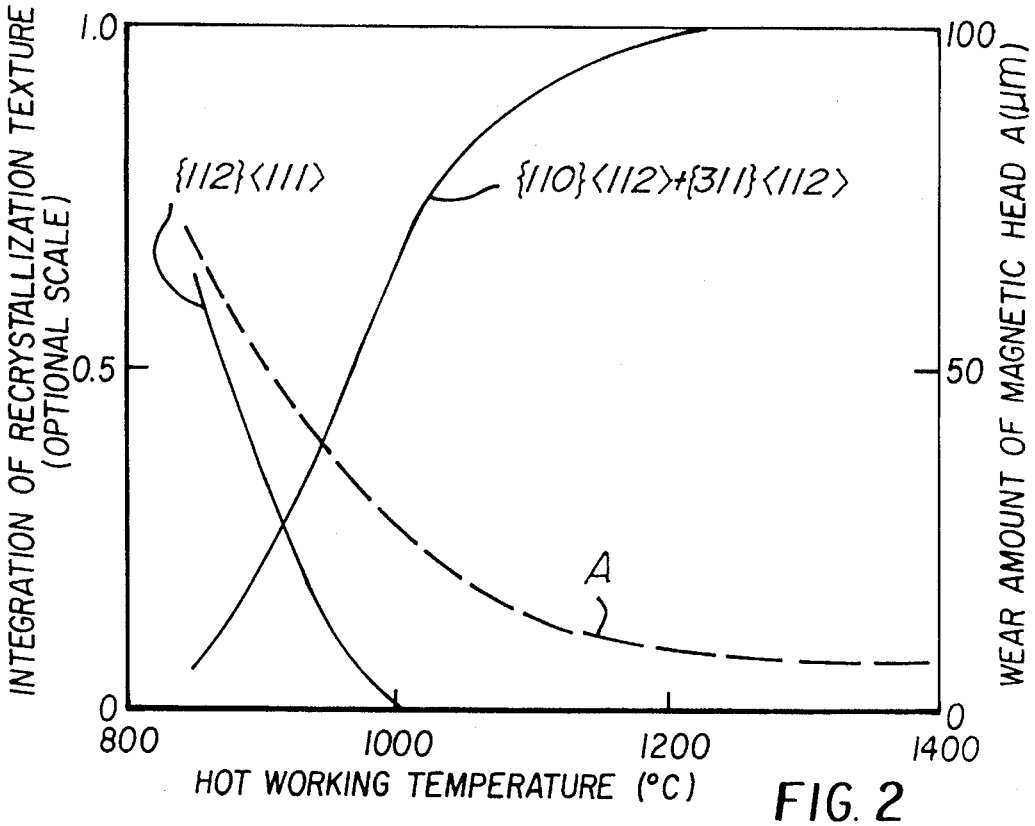
FIG. 2 is a graph showing the relationship between various properties and hot working temperature of 79.5% Ni—Fe-0.022% N-0.022% O alloy.

FIG. 2 is a graph showing the relationship of a hot working temperature, a recrystallization texture and a wear amount of a 79.5% Ni—Fe-5.5% Nb-0.022% N-0.022% O alloy. When the hot working temperature is increased more than 900° C., a recrystallization texture of {112}<111> is decreased, a recrystallization of {110}<112>+{311}<112> texture is increased, and a wear amount is considerably decreased.

Figure 3:
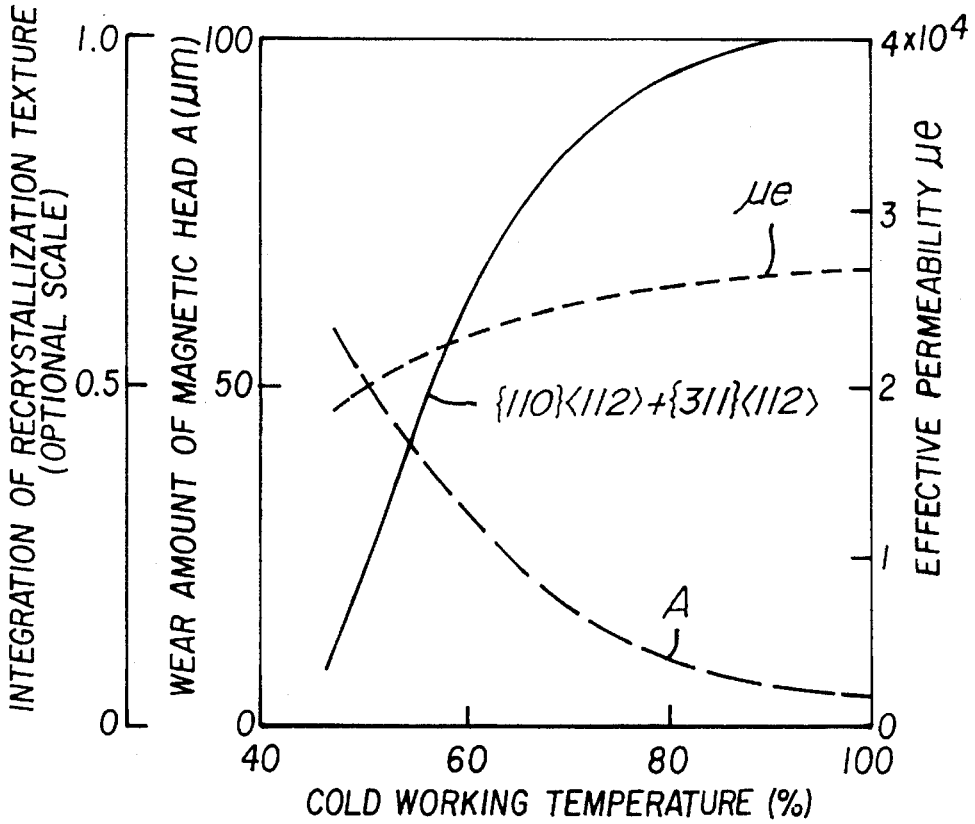
FIG. 3 is a graph showing the relationship between various properties and cold reduction ratio of 79.5% Ni—Fe-5.5% Nb-0.022% N-0.022% O alloy.

FIG. 3 is a graph showing the relationship of a recrystallization texture, various properties and a cold working ratio in case of heating a 79.5% Ni—Fe-5.5% Nb-0.022% N-0.022% O alloy at 1150° C., and the increase of a cold working ratio accelerates a development of a recrystallization texture of {110}<112>+{311}<112>, improves a wear resistance and increases an effective permeability.

Figure 4:
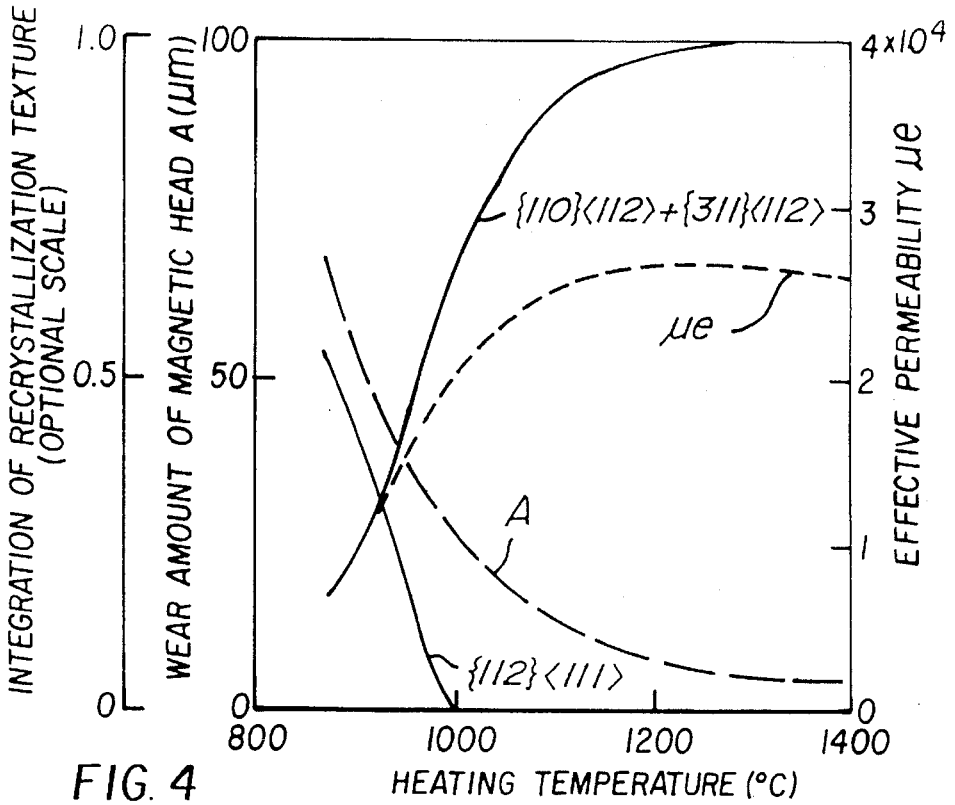
FIG. 4 is a graph showing the relationship between various properties and heating temperature of 79.5% Ni—Fe-5.5% Nb-0.022% N-0.022% O alloy.

FIG. 4 is a graph showing the relationship of a heating temperature, a recrystallization texture and various properties after rolling a 79.5% Ni—Fe-5.5% Nb-0.022% N-0.022% O alloy at 90% of a cold working ratio, and with the increase of a heating temperature, a component of {112}<111> of recrystallization texture decreases, a component of {110}<112>+{311}<112> of recrystallization texture develops, thereby the wear resistance improves and the effective permeability increases.

Figure 5:
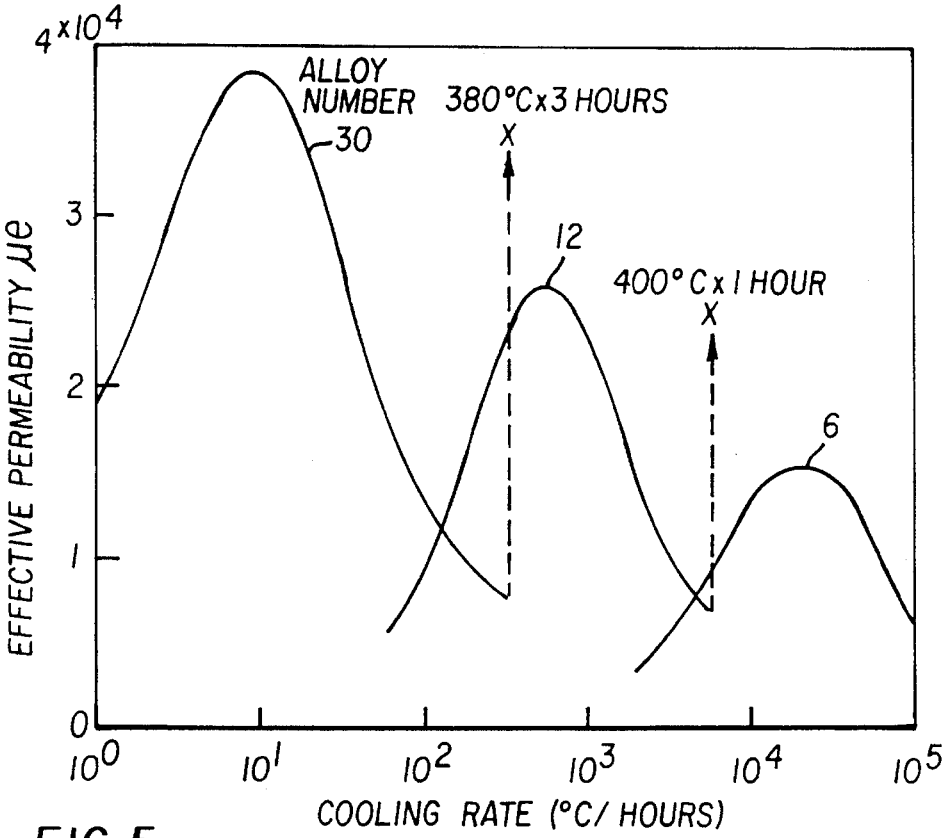
FIG. 5 is a graph showing the relationship between effective permeability and cooling rate, reheating temperature and reheating time of 79.0% Ni—Fe-2.5% Nb-0.1505% N-0.0072% O alloy (Alloy No. 6), 79.5% Ni—Fe-5.5% Nb-0.022% N-0.022% O alloy (Alloy No. 12) and 80.5% Ni—Fe-5.0% Nb-0.0136% N-0.024% O-4% Mo alloy (Alloy No. 30).

FIG. 5 is a graph showing the relationship between an effective permeability and a cooling rate of Alloy No. 6 (79.0% Ni—Fe-2.5% Nb-0.1505% N-0.0072% O alloy), Alloy No. 12 (79.5% Ni—Fe-5.5% Nb-0.022% N-0.022% O alloy) and Alloy No. 30 (80.5% Ni—Fe-5.0% Nb-0.0136% N-0.024% O-4% Mo alloy) and an effective permeability (mark ×) in case of further applying a reheating treatment to these alloys. As apparent from FIG. 5, when a reheating treatment is applied to a specimen of Alloy No. 30 at 380° C. for 3 hours, an effective permeability is remarkably improved such as $3.5\times10^4$. Moreover, when a reheating treatment is applied to a specimen of Alloy No. 12 at 400° C. for 1 hour, an effective permeability is improved such as $2.5\times10^4$. That is, it is understood that an optimum cooling rate, an optimum reheating temperature and reheating time corresponding to the composition of an alloy exists.

Figure 6:
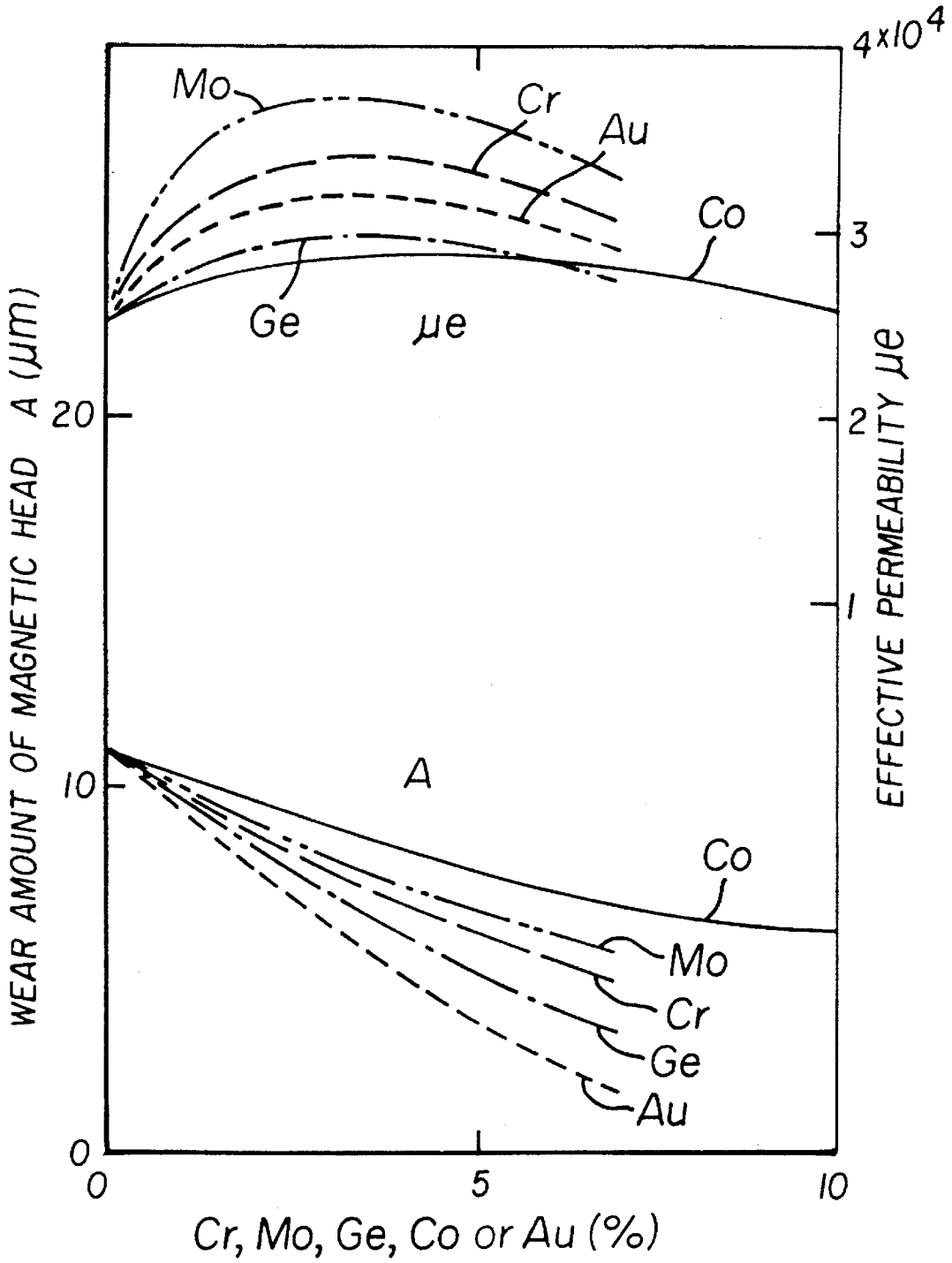
FIG. 6 is a graph showing the relationship between various properties and addition amount of each element in case of adding Cr, Mo, Ge, Au or Co to 79.5% Ni—Fe-5.5% Nb-0.022% N-0.022% O alloy.

FIG. 6 is a graph showing wear amount and effective permeability of a magnetic head in case of adding Cr, Mo, Ge, Au or Co to a 79.5% Ni—Fe-5.5% Nb-0.022% N-0.022% O alloy, and when Cr, Mo, Ge, Au or Co is added, an effective permeability becomes high and a wear amount decreases, but the addition of more than 7% of Cr, Mo, Ge or Au makes a saturated flux density less than 4000 G and is not preferable. Moreover, the addition of more than 10% of Co makes a residual magnetization large and a magnitization noise unfavorably increased.

Figure 7:
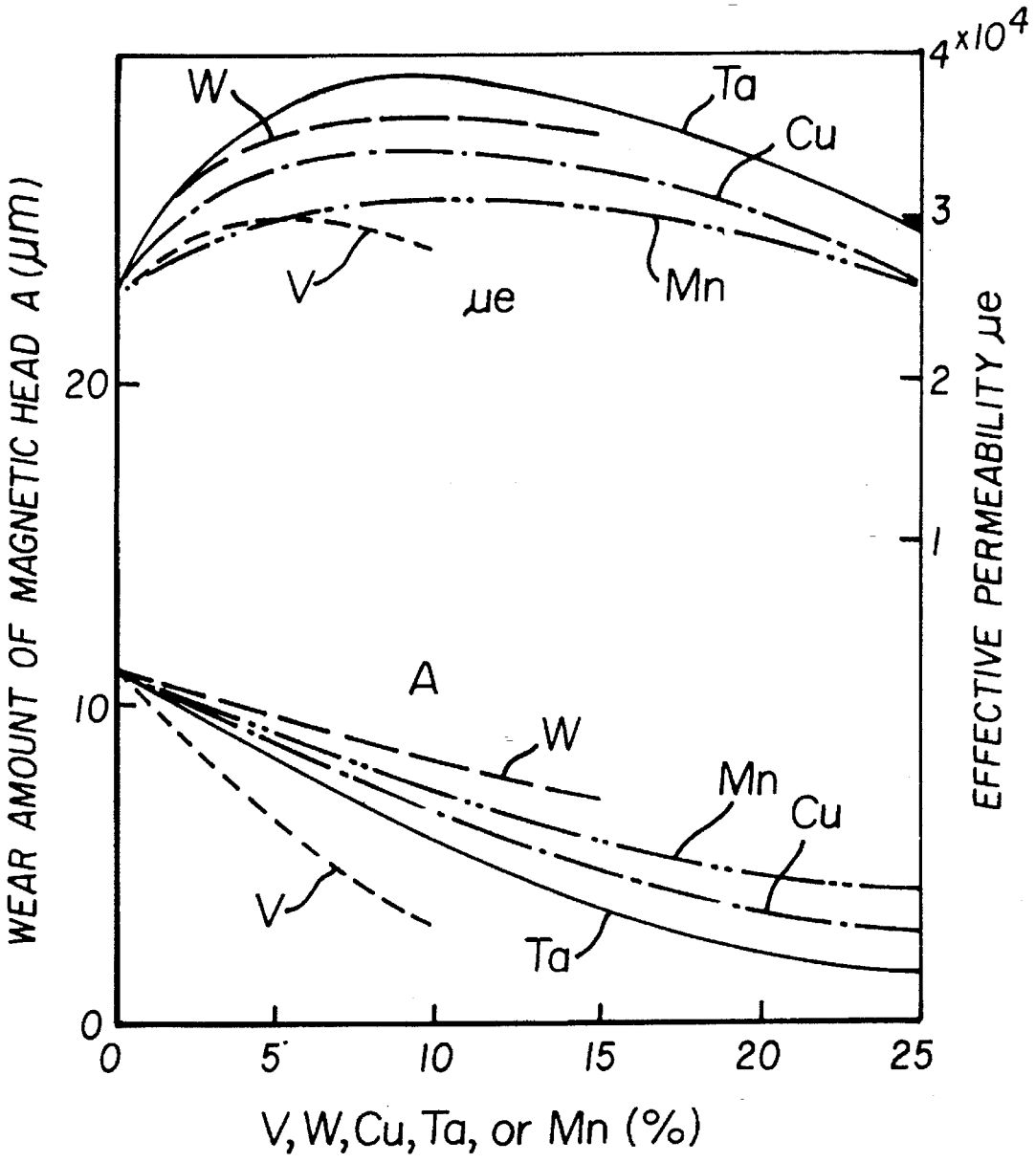
FIG. 7 is a graph showing the relationship between various properties and addition amount of each element in case of adding V, W, Cu, Ta or Mn to 79.5% Ni—Fe-5.5% Nb-0.022% N-0.022% O alloy.

FIG. 7 is a graph showing a wear amount and an effective permeability of a magnetic head in case of adding V, W, Cu, Ta or Mn to the same 79.5% Ni—Fe-5.5% Nb-0.022% N-0.022% O alloy, and when V, W, Cu, Ta or Mn is added, an effective permeability becomes high and a wear amount decreases, but when more than 10% of V, more than 15% of W and more than 25% of Cu, Ta or Mn are added thereto, a saturated flux density unfavorably becomes less than 4000 G.

Figure 8:
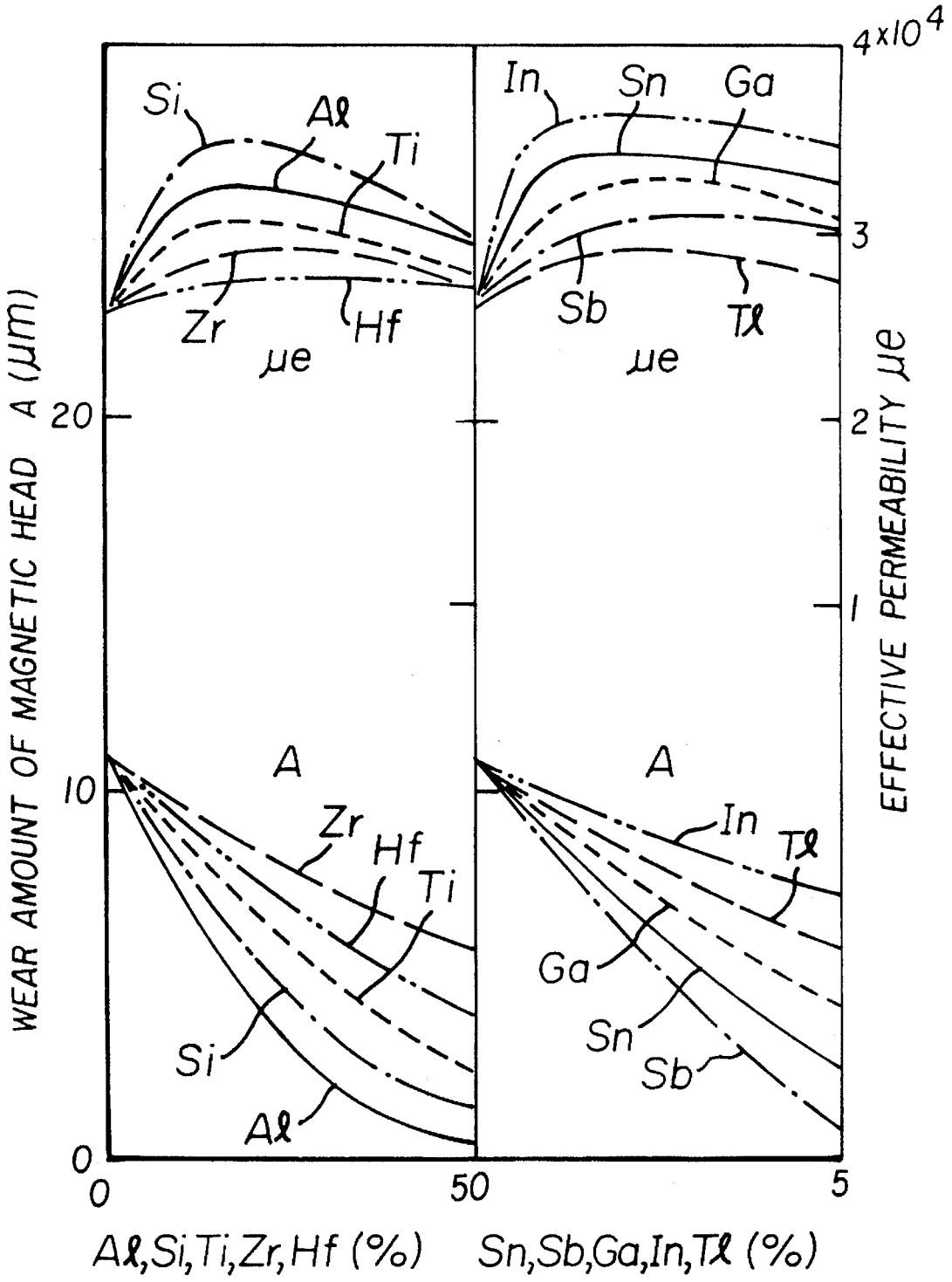
FIG. 8 is a graph showing the relationship between various properties and addition amount of each element in case of adding Al, Si, Ti, Zr, Hf, Sn, Sb, Ga, In or Tl to 79.5% Ni—Fe-5.5&Nb-0.022% N-0.022% O alloy.

FIG. 8 is a graph showing the case of adding Al, Si, Ti, Zr, Hf, Sn, Sb, Ga, In or Tl to the same 79.5% Ni—Fe-5.5% Nb-0.022% N-0.022% O alloy, and when Al, Si, Ti, Zr, Hf, Sn, Sb, Ga, In or Tl is added, an effective permeability becomes high and a wear amount decreases, but when more than 5% of Si, Ti, Zr, Hf, Ga, In or Tl is added, a saturated flux density becomes less than 4000 G, and when Al, Sn or Sb of more than 5% is added thereto, the forging becomes unfavorably difficult.

Figure 9:
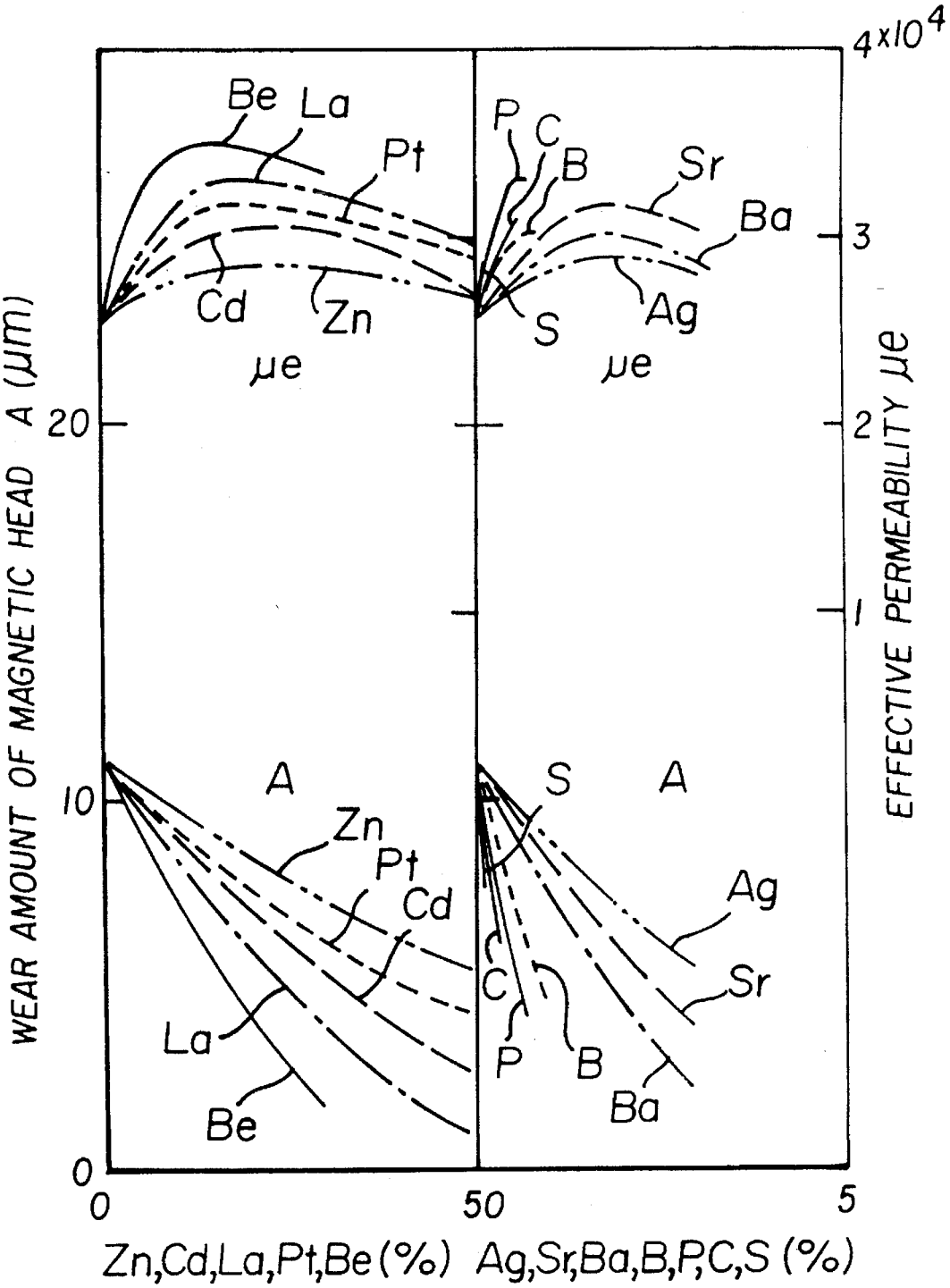
FIG. 9 is a graph showing the relationship between various properties and addition amount of each element in case of adding Zn, Cd, La, Pt, Be, Ag, Sr, Ba, B, P, C or S to 79.5% Ni—Fe-5.5% Nb-0.022% N-0.022% O alloy.

FIG. 9 is a graph showing the case of adding Zn, Cd, La, Pt, Be, Ag, Sr, Ba, B, P or S to the same 79.5% Ni—Fe-5.5% Nb-0.022% N-0.022% O alloy, and when Zn, Cd, La, Pt, Be, Ag, Sr, Ba, B, P, C or S is added, an effective permeability becomes high and a wear amount decreases, but when more than 5% of Zn, Cd, La and Pt and more than 3% of Be, Sr and Ba are added thereto, a saturated flux density becomes unfavorably less than 4000 G, and when more than 3% of Ag, more than 1% of B, more than 0.7% of P, more than 0.3% of C, or more than 0.1% of S is added thereto, forging becomes unfavorably difficult.

In the present invention, a hot working at a temperature exceeding 900° C. is necessary for accelerating the formation of a recrystallization texture of {110}<112>+{311}<112>, and a cold working is necessary for forming a texture of {110}<112>+{112}<111>, and for developing a recrystallization texture of {110}<112>+{311}<112> based thereon, and as seen in FIGS. 1, 2 and 3, in addition of more than 0.0003% in total of N and O, preferably more than 0.0005%, in case of hot working at a temperature exceeding 900° C., and thereafter cold working at more than 50% of a reduction ratio, a development of a recrystallization texture of {110}<112>+{311}<112> is remarkable, a wear resistance is considerably improved, and its effective permeability is high. Moreover, heating followed to the above cold working is necessary for developing a recrystallization texture of {110}<112>+{311}<112> together with an unification of a texture and a removal of working strain, and obtaining high effective permeability and wear resistance, but as seen in FIG. 4, an effective permeability and a wear resistance are remarkably improved by particularly heating at a temperature exceeding 900° C.

Moreover, a repetition of the above cold working and the following heating at a temperature exceeding 900° C. and below a melting point is effective for increasing integration of a recrystallization texture of {110}<112>+{311}<112> and improving wear resistance. In this case, even if the reduction ratio of a final cold working is less than 50%, a recrystallization texture of {110}<112>+{311}<112> is obtained, but it is included in a technical idea of the present invention. Therefore, the reduction ratio of the present invention means a reduction ratio summing up cold workings in the whole manufacturing steps, but does not mean a final cold working ratio only.

Cooling from a temperature exceeding 900° C. and below a melting point to a temperature more than an ordered-disordered lattice transportation point (about 600° C.) does not particularly have an influence upon magnetism which is obtained by quenching or slow cooling, but as seen in FIG. 5, a cooling rate of less than this transformation point has a great influence upon magnetism. That is, by cooling from a temperature above the transformation point to a room temperature at a suitable cooling rate of 100° C./sec to 1° C./hr corresponding to the composition, a degree of order is appropriately regulated, and an excellent magnetism is obtained. In the above cooling rate, if quenching is conducted at a cooling rate close to 100° C./sec, a degree of order becomes small, and if cooling is conducted at a faster rate, the order of degree does not proceed and becomes small to deteriorate magnetism. However, when an alloy having this small degree of order is reheated and cooled at 200° C.–600° C. below the transformation point for more than 1 minute and less than 100 hours corresponding to the composition, the degree of order proceeds to become an appropriate degree of order, and magnetism is improved. On the other hand, slow cooling is conducted from a temperature more than the above transformation point at a slow cooling rate such as less than 1° C./hr, the degree of order unfavorably proceeds, and magnetism is lowered.

Moreover, the above heat treatment in a hydrogen-existing atmosphere is particularly effective for increasing an effective permeability.

Embodiment

Examples of the present invention are explained below.

Example 1

Manufacture of Alloy No. 12 (composition Ni=79.5%, Nb=5.5%, N=0.022%, O=0.022%, Fe=the remainder)

As a raw material, use was made of electrolytic nickel and electrolytic iron of 99.9% purity and niobium of 99.8% purity. In order to manufacture a sample, the total weight 800 g of the raw material was charged in an alumina crucible, molten in vacuo in a high-frequency induction electric furnace, then fully stirred to form a homogeneous molten alloy. Then, the alloy is held in a mixed gas ($N_2$:$O_2$=1:1) atmosphere of nitrogen and oxygen in total pressure of $3\times10^{-1}$ for 13 minutes, thereafter injected in a mold having a hole of 25 mm in diameter and 170 mm in height, and the thus obtained ingot was forged at about 1150° C. to form a sheet of about 7 mm in thickness. Moreover, the sheet was hot rolled to a suitable thickness at a temperature between above 1000° C. and 1300° C., then cold worked at a room temperature and with various reduction ratios to form a thin sheet of 0.1 mm, and the thin sheet was punched into a ring sheet of 45 mm in outer diameter and 33 mm in inner diameter. Next, in case of applying various heat treatments thereto and using as a core of magnetic properties and a magnetic head, the wear amount of a magnetic tape after running for 300 hours at 85% humidity and 45° C. was measured by a Tarrysurf surface roughness gauge and their properties shown in Table 1 were obtained.

TABLE 1

| Working and Heat treatment | Effective permeability (μe) | Saturated flux density Bs (G) | Coercive force Hc (Oe) | Wear amount (μm) |
|---|---|---|---|---|
| Rolled at 30% cold reduction ratio, heated in hydrogen at 1,150° C. for 2 hours and cooled at 600° C./hr | 18500 | 7400 | 0.021 | 88 |
| Rolled at 70% cold reduction ratio, heated in hydrogen at 1,150° C. for 2 hours and cooled at 600° C./hr | 24200 | 7400 | 0.014 | 22 |
| rolled at 90% cold reduction ratio, heated in hydrogen at 700° C. for 3 hours and cooled at 600° C./hr | 12200 | 7380 | 0.030 | 95 |
| Rolled at 90% cold reduction ratio, heated in hydrogen at 1,150° C. for 2 hours and cooled at 600° C./hr | 25800 | 7420 | 0.013 | 11 |
| Rolled at 90% cold reduction ratio, heated in hydrogen at 1,100° C. for 2 hours and cooled at 600° C./hr | 26000 | 7440 | 0.012 | 10 |
| Rolled at 90% cold reduction ratio, heated in hydrogen at 1,200° C. for 1 hour and cooled at 600° C./hr | 26100 | 7450 | 0.011 | 8 |
| Rolled at 98% cold reduction ratio, heated in hydrogen at 1,100° C. for 1 hour and cooled at 600° C./hr | 25500 | 7420 | 0.014 | 8 |

Example 2

Manufacture of Alloy No. 42 (Composition Ni=76.0%, Nb=3.0%, N=0.026%, O=0.0158%, Ta=10.0%, Fe=the remainder)

As a raw material, use was made of electrolytic nickel, electrolytic iron and niobium of the same purities as those in Example 1 and tantalum of 99.8% purity.

In order to manufacture a sample, the total weight 800 g of the raw material was charged in an alumina crucible, molten in a mixed gas atmosphere of nitrogen and oxygen ($N_2$:$O_2$=6:4) in total pressure of $6\times10^{-1}$ by a high frequency induction electric furnace, then fully stirred to form a homogeneous molten alloy. Then, the alloy was injected in a mold having a hole of 25 mm in diameter and 170 mm in height, and the thus the obtained ingot was forged at a temperature of about 1250° C. to form a sheet of about 7 mm in thickness. Moreover, the sheet was hot rolled to a suitable thickness at a temperature between above 1000° C. and 1400° C., then cold rolled at a room temperature and with various reduction ratios to form a thin sheet of 0.1 mm, and punched into a ring sheet of 45 mm in outer diameter and 33 mm in inner diameter.

Then, in case of applying various heat treatments thereto and using as a core of magnetic head and an magnetic properties, the wear amount of a magnetic tape running for 300 hours at 85% humidity and 45° C. was measured by a Tarrysurf surface roughness gauge, and properties shown in Table 2 were obtained.

Moreover, properties of typical alloys are as shown in Tables 3 and 4.

TABLE 2

| Working and Heat treatment | Effective permeability (μe) | Saturated flux density Bs (G) | Coercive force Hc (Oe) | Wear amount (μm) |
|---|---|---|---|---|
| Rolled at 30% cold reduction ratio, heated in hydrogen at 1,250° C. for 2 hours and cooled at 100° C./hr | 37400 | 6670 | 0.006 | 85 |

TABLE 2-continued

| Working and Heat treatment | Effective permeability (μe) | Saturated flux density Bs (G) | Coercive force Hc (Oe) | Wear amount (μm) |
|---|---|---|---|---|
| Rolled at 70% cold reduction ratio, heated in hydrogen at 1,250° C. for 2 hours and cooled at 100° C./hr | 38300 | 6680 | 0.006 | 10 |
| rolled at 95% cold reduction ratio, heated in hydrogen at 800° C. for 3 hours and cooled at 100° C./hr | 12700 | 6350 | 0.031 | 72 |
| Rolled at 95% cold reduction ratio, heated in hydrogen at 1,100° C. for 2 hours and cooled at 100° C./hr | 36600 | 6700 | 0.006 | 7 |
| Rolled at 95% cold reduction ratio, heated in hydrogen at 1,050° C. for 2 hours and cooled at 100° C./hr | 34200 | 6690 | 0.007 | 8 |
| Rolled at 95% cold reduction ratio, heated in hydrogen at 1,250° C. for 1 hour and cooled at 100° C./hr | 39300 | 6700 | 0.005 | 6 |
| Rolled at 95% cold reduction ratio, heated in hydrogen at 1,350° C. for 1 hour and cooled at 100° C./hr | 39000 | 6690 | 0.005 | 5 |

TABLE 3

| Alloy | Composition (%) (Remainder Fe) | | | | | Cold reduction ratio | Heating temperature | Cooling rate |
|---|---|---|---|---|---|---|---|---|
| No. | Ni | Nb | N | O | Secondary component | (%) | (°C.) | (°C./hr) |
| 6 | 79.0 | 2.5 | 0.1505 | 0.0072 | — | 95 | 1100 | 2000 |
| 12 | 79.5 | 5.5 | 0.0220 | 0.0220 | — | 90 | 1150 | 600 |
| 17 | 79.8 | 9.0 | 0.0630 | 0.0205 | — | 85 | 1200 | 600 |
| 24 | 80.3 | 11.0 | 0.0108 | 0.0310 | — | 75 | 1050 | 1000 |
| 30 | 80.5 | 5.0 | 0.0136 | 0.0240 | Mo 4.0 | 90 | 1050 | 10 |
| 35 | 82.0 | 4.0 | 0.0050 | 0.0184 | V 5.0 | 80 | 1100 | 2000 |
| 42 | 76.0 | 3.0 | 0.0260 | 0.0158 | Ta 10.0 | 95 | 1250 | 100 |
| 48 | 83.3 | 6.0 | 0.0005 | 0.0416 | Cr 3.0, In 2.0 | 70 | 1050 | 800 |
| 56 | 78.0 | 4.5 | 0.0272 | 0.0057 | Ge 4.0, Cd 1.0 | 85 | 1200 | 1500 |
| 61 | 79.5 | 7.0 | 0.0142 | 0.0110 | Au 3.0, Zn 1.2 | 65 | 1050 | 1500 |
| 66 | 75.0 | 6.5 | 0.0210 | 0.0080 | Co 7.0, Ba 1.0 | 70 | 1100 | 600 |
| 73 | 65.0 | 6.0 | 0.0162 | 0.0107 | Cu 17.0, Ag 1.5 | 90 | 1150 | 50 |
| 79 | 74.0 | 5.5 | 0.0710 | 0.0008 | Mn 10.0, B 0.1 | 80 | 1100 | 400 |
| 82 | 83.5 | 3.5 | 0.0247 | 0.0016 | Al 1.5, Sr 1.0 | 98 | 1200 | 5000 |
| 85 | 82.0 | 4.0 | 0.0030 | 0.0545 | Si 3.0, Tl 1.5 | 90 | 1100 | 800 |
| 87 | 79.2 | 5.0 | 0.0460 | 0.0070 | Ti 2.0, Ce 1.3 | 80 | 1050 | 600 |
| 93 | 81.3 | 6.0 | 0.0103 | 0.0200 | Zr 2.5, Pt 2.0 | 75 | 1050 | 200 |
| 96 | 78.8 | 4.5 | 0.1102 | 0.0005 | Hf 3.0, Ga 1.5 | 95 | 1200 | 800 |
| 102 | 80.4 | 7.0 | 0.0010 | 0.0350 | Sn 1.0, P 0.1 | 80 | 950 | 1000 |
| 108 | 81.0 | 6.0 | 0.0246 | 0.0132 | Sb 1.0, S 0.05 | 90 | 1030 | 400 |
| 114 | 71.0 | 5.5 | 0.0268 | 0.0063 | W 7.0, Be 0.5 | 85 | 1300 | 800 |
| 119 | 79.0 | 8.0 | 0.0042 | 0.0325 | Mo 3.0, La 1.0 | 60 | 1150 | 50 |
| 126 | 79.5 | 6.5 | 0.0143 | 0.0162 | Ru 2.0, Cr 1.0 | 85 | 1200 | 3000 |
| 130 | 68.0 | 1.5 | 0.1010 | 0.0047 | Ta 15.0, Nd 1.0 | 95 | 1050 | 1500 |
| 135 | 72.5 | 7.0 | 0.0064 | 0.0235 | Y 1.5, Cu 7.0 | 75 | 1100 | 400 |
| 142 | 75.0 | 5.5 | 0.0241 | 0.0051 | Rh 3.0, H 5.0 | 90 | 1050 | 800 |
| 151 | 79.7 | 6.0 | 0.0137 | 0.0205 | V 3.5, C 0.1 | 95 | 1100 | 400 |
| permalloy | 78.5 | — | — | — | — | 98 | 1100 | 100000 |

TABLE 4

| Alloy No. | Reheating temperature (°C.) time (hour) | Effective permeability μe (1 KHz) | Saturated flux density (G) | Coercive force (Oe) | Wear amount (μm) |
|---|---|---|---|---|---|
| 6 | — | 15200 | 8030 | 0.021 | 16 |
| 12 | — | 25800 | 7420 | 0.013 | 11 |
| 17 | — | 23500 | 6180 | 0.015 | 9 |
| 24 | 380, 5 | 18600 | 5060 | 0.018 | 8 |
| 30 | — | 38500 | 6520 | 0.008 | 6 |
| 35 | 350, 10 | 30100 | 6550 | 0.012 | 6 |
| 42 | — | 39300 | 6700 | 0.005 | 6 |
| 48 | — | 34200 | 6580 | 0.008 | 4 |
| 56 | 400, 1 | 31800 | 6290 | 0.015 | 5 |
| 61 | 420, 1 | 32500 | 6140 | 0.012 | 5 |
| 66 | — | 29600 | 8620 | 0.020 | 5 |
| 73 | — | 34100 | 6630 | 0.010 | 3 |
| 79 | — | 31000 | 6820 | 0.015 | 2 |
| 82 | 400, 2 | 33900 | 7260 | 0.008 | 4 |
| 85 | — | 37800 | 6850 | 0.006 | 5 |
| 87 | — | 33400 | 6620 | 0.010 | 4 |
| 93 | — | 32600 | 6370 | 0.012 | 3 |
| 96 | — | 29800 | 6400 | 0.015 | 5 |
| 102 | 380, 3 | 36200 | 6080 | 0.008 | 4 |
| 108 | — | 33400 | 6360 | 0.016 | 4 |
| 114 | — | 38050 | 5940 | 0.007 | 6 |
| 119 | — | 39000 | 5880 | 0.006 | 5 |
| 126 | 420, 2 | 35200 | 6240 | 0.009 | 4 |
| 130 | 300, 50 | 39800 | 6450 | 0.005 | 2 |
| 135 | — | 36100 | 6130 | 0.008 | 3 |
| 142 | — | 39100 | 6070 | 0.005 | 4 |
| permalloy | — | 2800 | 10800 | 0.055 | 180 |

As described above, the present alloy is easily worked, has excellent wear resistance, and has a saturated flux density of more than 4000 G, a high effective permeability of more than 3000 and a low coercive force. The present alloy is suitable as not only magnetic alloy for a core and case of magnetic recording and reproducing head but also as a magnetic material of general electromagnetic devices requiring wear resistance and high permeability.

In the present invention, the reason why the composition of an alloy is limited to 60–90% Ni, 0.5–14% Nb, 0.0003–0.3% in total of N and O (but excluding 0% of N and O) and the remainder Fe, and the element added as a secondary component is limited to 0.001–30% in total of at least one element selected from the group consisting of less than 7% of Cr, Mo, Ge or Au, less than 10% of Co or V, less than 15% of W, less than 25% of Cu, Ta or Mn, less than 5% of Al, Si, Ti, Zr, Hf, Sn, Sb, Ga, In, Tl, Zn, Cd, rare earth element or platinum element, less than 3% of Be, Ag, Sr or Ba, less than 1% of B, less than 0.7% of P, less than 0.3% of C, and less than 0.1% of S, is as apparent from each example, Tables 3 and 4 and drawings, because in this composition range an effective permeability is more than 3000, a saturated flux density is more than 4000 G, a recrystallization texture of {110}<112>+{311}<112>, and excellent wear resistance exist, but outside this composition range, a magnetic property or a wear resistance is deteriorated.

That is, with less than 0.5% Nb and less than 0.0003% N and O in total, a recrystallization texture of {110}<112>+{311}<112> is not sufficiently developed, so that wear resistance is worse, and with more than 14% Nb and more than 0.3% N and O in total, forging becomes difficult, and an effective permeability becomes less than 3000 and a saturated flux density becomes less than 4000 G.

An alloy within a composition range of 60–90% Ni, 0.5–14% Nb, 0.0003–0.3% N and O in total and the remainder Fe is excellent in the wear resistance and good in workability at more than 3000 of effective permeability and more than 4000 G of saturated flux density, but if at least one element selected from the group consisting of Cr, Mo, Ge, Au, W, V, Cu, Ta, Mn, Al, Zr, Si, Ti, Hf, Ga, In, Tl, Zn, Cd, rare earth element, platinum element, Be, Ag, Sr, Ba, B, P, C and S is added thereto in general, an effective permeability is increased, and if Co is added thereto, a saturated flux density is particularly increased, and if either one element of Au, Mn, Ti, Co, rare earth element, Be, Sr, Ba and B is added thereto, a forging and a working become effectively smooth, and the addition of either one element of Al, Sn, Sb, Au, Ag, Ti, Zn, Cd, Be, Ta, V, P, C and S and nitrides and oxides of each element of secondary components develop a recrystallization texture of {110}<112>+{311}<112> and increase the wear resistance.

The rare earth element consists of Sc, Y and lanthanum elements, but its effects are equal, and the platinum element consists of Pt, Ir, Ru, Rh, Pd and Os, but its effects are also equal and they are observed as the same effect component.

In short, the alloy of the present invention is easy in forging, has an excellent wear resistance, more than 4000 G of a saturated flux density and a high effective permeability by forming a recrystallization texture of {110}<112>+{311}<112>, so that it is suitable as not only magnetic alloy for magnetic recording and reproducing head but also a magnetic material requiring a wear resistance and high permeability of general electromagnetic devices.

We claim:

1. A wear-resistant high permeability alloy comprising Ni in an amount of 60–90 wt. %, Nb in an amount of 0.5–14 wt. %, N and O in an amount of 0.0003–0.3 wt. % in total, and a remainder of Fe, the alloy having a recrystallization texture of {110}<112>+{311}<112>, an effective permeability of more than 3000 at 1 KHz and a saturated flux density of more than 4000 G.

2. The wear-resistant high permeability alloy of claim 1, wherein the alloy contains by weight 0.0005–0.3% N and O in total.

3. A wear-resistant high permeability alloy comprising Ni in an amount of 60–90 wt. %, Nb in an amount of 0.5–14 wt. %, N and O in an amount of 0.0003–0.3 wt. % in total, a secondary component in an amount of 0.001–30 wt. % in total of at least one element selected from the group consisting of less than 7% of Cr, Mo, Ge and Au, respectively, less than 10% of Co and V, respectively, less than 15% of W, less than 25% of Cu, Ta and Mn, respectively, less than 5% of Al, Si, Ti, Zr, Hf, Sn, Sb, Ga In, Tl, Zn, Cd, rare earth element and platinum element, respectively, less than 3% of Be, Ag, Sr and Ba, respectively, less than 1% of B, less than 0.7% of P and less than 0.1% of S, and a remainder of Fe, the alloy having a recrystallization texture of {110}<112>+{311}<112>, an effective permeability of more than 3000 at 1 KHz and a saturated flux density of more than 4000 G.

4. The wear-resistant high permeability alloy of claim 3, wherein the alloy further comprises less than 0.3% of C.

5. The wear-resistant high permeability alloy of claim 3, wherein the alloy contains by weight 0.0005–0.3% N and O in total.

6. A magnetic recording reproducing head comprised of a wear-resistant high permeability alloy including Ni in an amount of 60–90 wt. %, Nb in an amount of 0.5–14 wt. %, N and O in an amount of 0.0003–0.3 wt. % in total, and a remainder of Fe, the alloy having a recrystallization texture of {110}<112>+{311}<112>, an effective permeability of more than 3000 at 1 KHz and a saturated flux density of more than 4000 G.

7. The wear-resistant high permeability alloy of claim 6, wherein the alloy contains by weight 0.0005–0.3% N and O in total.

8. A magnetic recording reproducing head comprised of a wear-resistant high permeability alloy including Ni in an amount of 60–90 wt. %, Nb in an amount of 0.5–14 wt. %, N and O in an amount of 0.0003–0.3 wt. % in total, a secondary component in an amount of 0.001–30 wt. % in total of at least one element selected from the group consisting of less than 7% of Cr, Mo, Ge and Au, respectively, less than 10% of Co and V, respectively, less than 15% of W, less than 25% of Cu, Ta and Mn, respectively, less than 5% of Al, Si, Ti, Zr, Hf, Sn, Sb, Ga In, Tl, Zn, Cd, rare earth element and platinum element, respectively, less than 3% of Be, Ag, Sr and Ba, respectively, less than 1% of B, less than 0.7% of P and less than 0.1% of S, and a remainder of Fe, the alloy having a recrystallization texture of {110}<112>+{311}<112>, an effective permeability of more than 3000 at 1 KHz and a saturated flux density of more than 4000 G.

9. The wear-resistant high permeability alloy of claim 8, wherein the alloy contains by weight 0.0005–0.3% N and O in total.

* * * * *